United States Patent [19]

Cantey

[11] Patent Number: 4,502,597

[45] Date of Patent: Mar. 5, 1985

[54] SHIPPING PALLET

[76] Inventor: Bryant W. Cantey, P.O. Box 8998, Greenville, S.C. 29604

[21] Appl. No.: 495,114

[22] Filed: May 16, 1983

[51] Int. Cl.[3] ..... B65D 85/02; B65D 85/66

[52] U.S. Cl. ..... 206/392; 108/51.3; 108/55.3; 206/408; 206/486; 229/DIG. 2; 248/346

[58] Field of Search ..... 108/55.1, 55.3, 56.3, 108/51.3; 206/150–154, 158, 372, 382, 386, 391–394, 408, 462, 463, 476, , 486, 488, 489, 600; 217/43 A; 229/DIG. 2; 242/222; 248/346

[56] References Cited

U.S. PATENT DOCUMENTS

| | | | |
|---|---|---|---|
| 2,699,866 | 1/1955 | Russell, Jr. | 206/392 |
| 3,285,412 | 11/1966 | Knight et al. | 206/486 |
| 3,621,995 | 11/1971 | Francis | 206/392 |
| 3,804,234 | 4/1974 | Gordon | 206/392 |
| 4,098,400 | 7/1978 | Brown | 206/386 |
| 4,390,154 | 6/1983 | Ostler et al. | 108/51.3 |

FOREIGN PATENT DOCUMENTS

| | | | |
|---|---|---|---|
| 2363493 | 3/1978 | France | 206/151 |
| 428699 | 5/1935 | United Kingdom | 242/222 |

*Primary Examiner*—George E. Lowrance
*Assistant Examiner*—Jimmy G. Foster
*Attorney, Agent, or Firm*—Bailey & Hardaway

[57] ABSTRACT

A shipping pallet is formed from a backing member which comprises at least two thicknesses of corrugated material and which has on the edges for a substantial majority of the perimeter folded corrugated material with only a minor portion of the perimeter comprising severed corrugated material. Backing member also defines passageways for mechanized handling.

3 Claims, 4 Drawing Figures

SHIPPING PALLET

BACKGROUND OF THE INVENTION

This invention relates generally to the art of shipment, and more particularly to a shipping pallet for use in the handling of wound bobbins of textile fiber.

Many articles are shipped in commerce which must be grouped and appropriately stabilized for shipment. This grouping and stabilization usually involves the use of a support or container which, itself, represents a significant investment when a large number of articles are shipped. Due to such investment, it is preferred that the means for shipment be reusable and returnable in a form which involves minimization of weight and volume.

One such group of articles which is shipped significant distances and which is subject to the above limitation are wound bobbins of textile fiber. Normally, many thousands of such wound bobbins are shipped at one time to be utilized in weaving and other processes.

Various prior art devices have been utilized for shipment of a plurality of bobbins having fibers wound thereon. One such device is described in U.S. Pat. No. 2,610,735 wherein an article locator having a central flange is trapped between two pieces of paperboard or corrugated material, with the locator protruding from either side of the paperboard in order to centrally locate a yarn bobbin thereon. The yarn bobbin is thus located by the locator, but rests upon the paperboard.

Another such device is described in U.S. Pat. No. 4,042,108 wherein a unitary plastic structure is utilized as a shipping pallet and comprises a plurality of bullet-shaped protuberances which are arranged so as to provide for minimum space consumption upon return shipment. Another unitary plastic device for use as a shipping pallet is described in U.S. Pat. No. 3,335,858 to Sibille.

Another shipping device is disclosed in U.S. Pat. No. 3,804,234 to Gordon wherein yarn bobbins are essentially boxed within a support structure formed from corrugated cardboard. Another corrugated cardboard device is described in U.S. Pat. No. 1,808,651 to Gibb et al.

Another improved shipping pallet is described in co-pending application Ser. No. 382,151 filed May 26, 1982 of a common inventorship herewith.

While all the above prior art devices provide means for shipment from the point of manufacture to the point of use, none of said shipping pallets have incorporated therein any means for accommodation once the pallets have arrived at the point of use.

SUMMARY OF THE INVENTION

It is thus an object of this invention to provide a novel shipping pallet for use in shipping a plurality of articles.

It is a further object of this invention to provide such a shipping pallet which possesses means for accommodating handling of the articles when at the point of ultimate use.

It is a still further and more particular object of this invention to provide such a shipping pallet which has a maximum portion of the edges thereof being folded material and only a minor portion thereof exposing severed corrugated material.

These as well as other objects are accomplished by a shipping pallet formed from a backing member which comprises at least two thicknesses of corrugated material and having folded corrugated material on the edges thereof for a substantial majority of its perimeter, with only a minor portion of the perimeter comprising severed corrugated material. The backing member also defines at least two passageways therethrough to permit mechanized handling thereof at the point of use.

DETAILED DESCRIPTION

In accordance with this invention it has been found that a shipping pallet may be formed for use in shipping a plurality of similarly shaped articles, such as wound yarn bobbins, and produced from a folded corrugated backing member folded in such a manner as to have a majority of its perimeter formed from folded corrugated material with only a minor portion of the perimeter comprising severed corrugated material. Such backing member possesses openings therethrough not only for the housing of locating members for the articles to be shipped, but additionally possesses passageways therethrough so that the shipping pallets may be readily handleable by automated robotic equipment at the point of packing and point of use. Various other advantages and features will become apparent from a reading of the following description with reference to the various figures of drawing.

Figure 1:
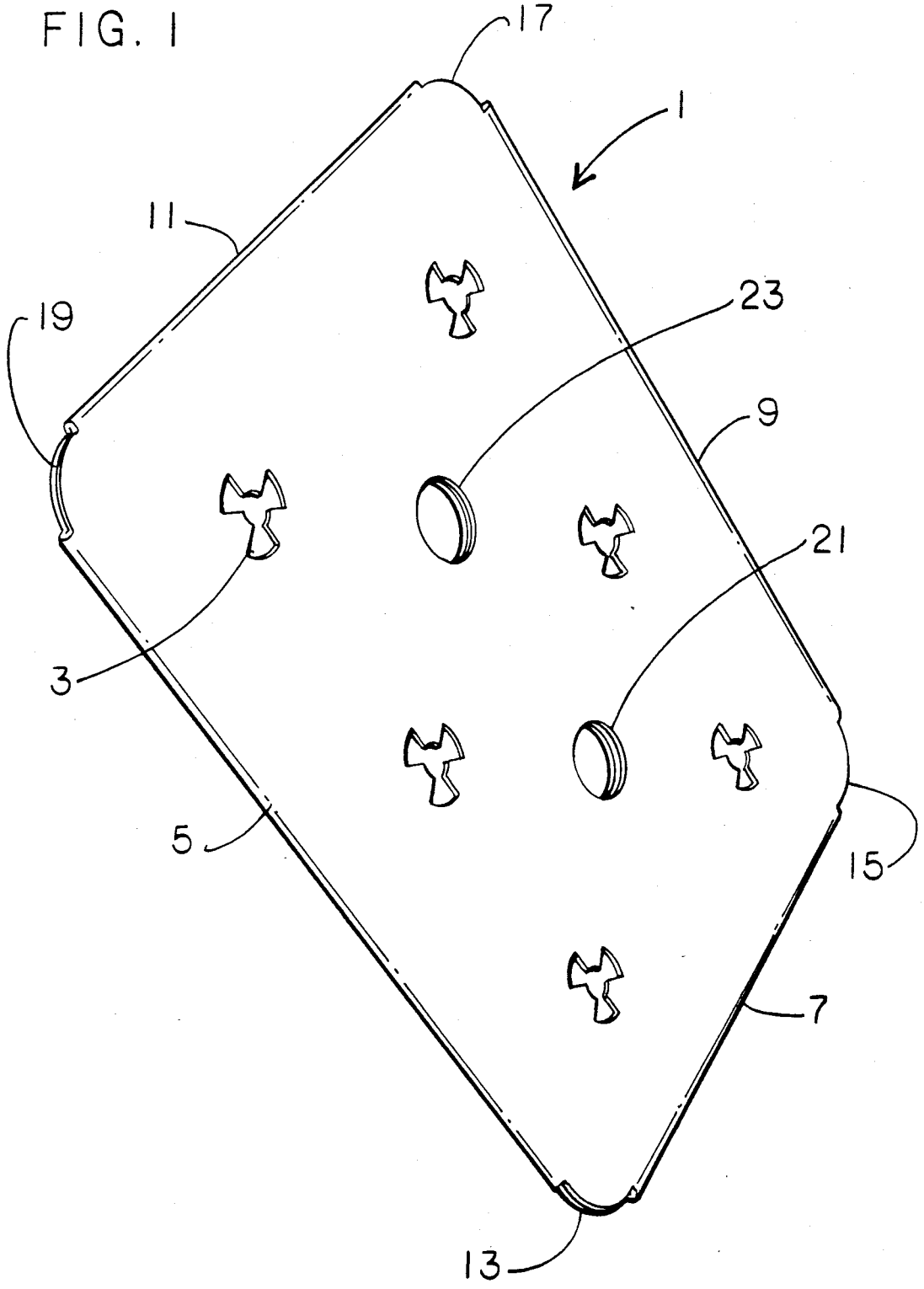
FIG. 1 of the drawings illustrates in perspective view a shipping pallet in accordance with this invention.

FIG. 1 of the drawings illustrates a shipping pallet 1 in accordance with this invention having a plurality of apertures 3 therein for receipt of article holding means. It is understood that various of the shipping pallets will have article holding means on each side thereof so that during shipment the articles may be layered such that six or eight shipping pallets may be stacked one on top of the other with articles to be shipped spaced therebetween. However, the top and bottom pallets will have apertures only on one side thereof since there will not be an adjacent row on one side thereof. For purposes of further discussion, the shipping pallet illustrated herein is such a top or bottom pallet.

The shipping pallet 1 illustrated in FIG. 1 of the drawings is formed of corrugated cardboard and is generally rectangular. The perimeter of the shipping pallet is defined in substantial majority by folded edges 5, 7, 9 and 11 each of which have respective adjacent folds. Only the arcuate corners thereof 13, 15, 17 and 19 expose severed corrugation. This configuration has been found to possess substantial advantage for use during shipment, in that the use of exposed corrugation at an edge imposes significant wear which is not imposed upon folded edges.

Figure 2:
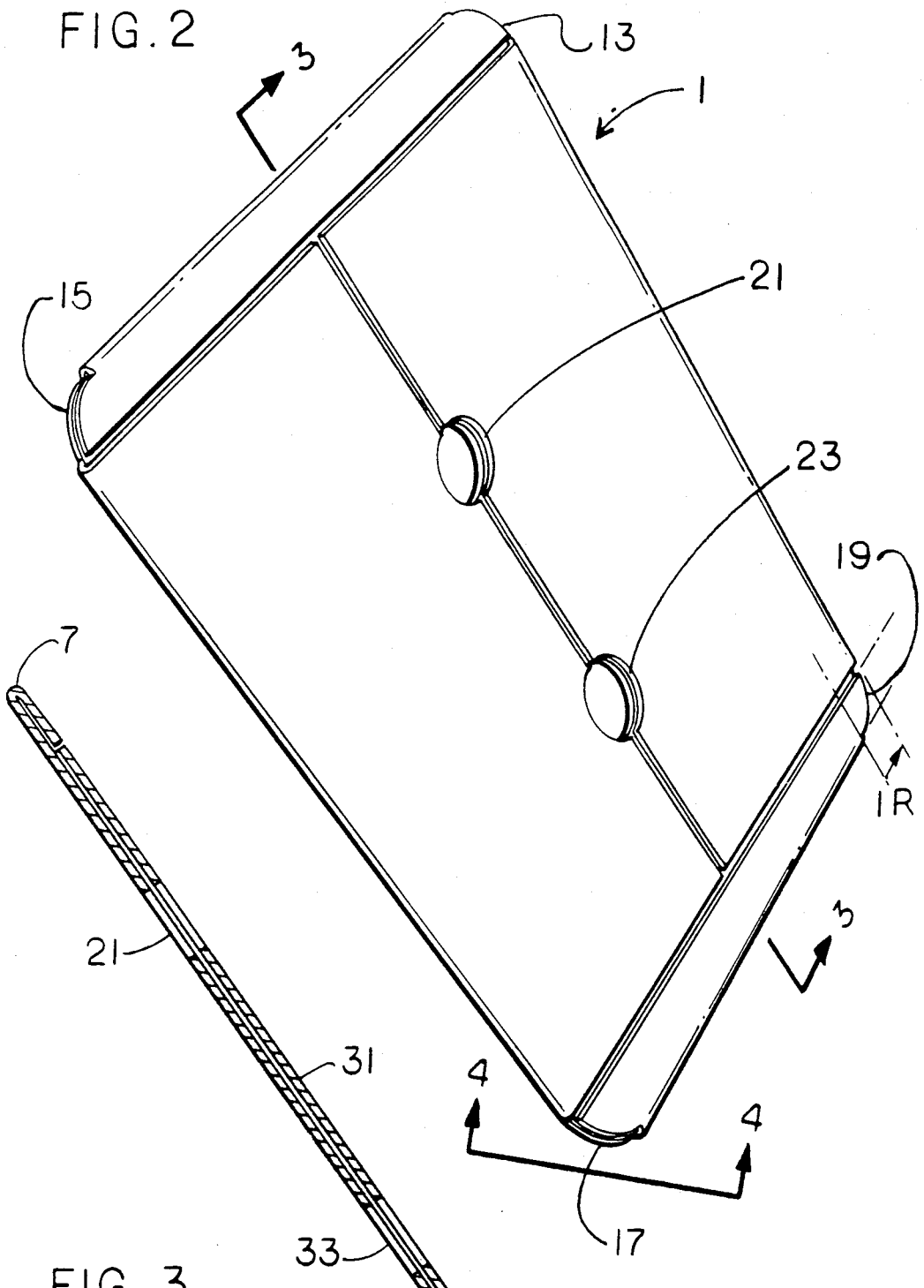
FIG. 2 of the drawings illustrates in perspective view the opposite side of the shipping pallet illustrated in FIG. 1.

FIG. 2 of the drawings shows the opposite side of pallet 1 as illustrated in FIG. 1 and illustrates the folding pattern thereof. The shipping pallet 1 may be produced from a single unitary sheet of corrugated material such as corrugated cardboard. It is seen that the cut edges of the corrugation of each of the folds form a generaly "I" shaped pattern when folded in accordance with this invention. The arcuate corners 13, 15, 17 and 19, while exposing severed corrugation, minimize wear at that point by the arcuate configuration. If such corners maintain the original rectangular configuration, the sharp corner thereof represents a high stress area which would rapidly deteriorate during use and extend that deterioration into functional areas of the shipping pallet. Preferably, the arcuate corners are formed of a 90° arc such that the radius curvature of the arc is substantially the length of the edge area trimmed from the otherwise sharp corner. This is generally designated by the radius R in FIG. 2, which is also the width of the shorter folds at opposing sides of the backing member.

Illustrated in FIGS. 1 and 2 are passageways 21 and 23. These passageways represent a significant advance in the technology involved, in that the pallets possess not only the ability for use during shipment of articles but now also provide means for automated handling at the point of use. Robotic fingers, for example, may extend through passageways 21 and 23 for the removal of the shipping pallet and exposure to the articles therebelow, such as wound bobbins of yarn. Robotic fingers may thus extend through a single shipping pallet or through a stack of such pallets having articles therebetween. Automated handling was not possible in the shipping pallets heretofore utilized. Prior to the invention herein, pallets required manual maneuvering of same during use. This has been found to be extremely advantageous when the articles are wound bobbins of yarn since the robotic device may be programmed to not only handle the shipping pallet but the individual wound bobbins of yarn.

Figure 3:
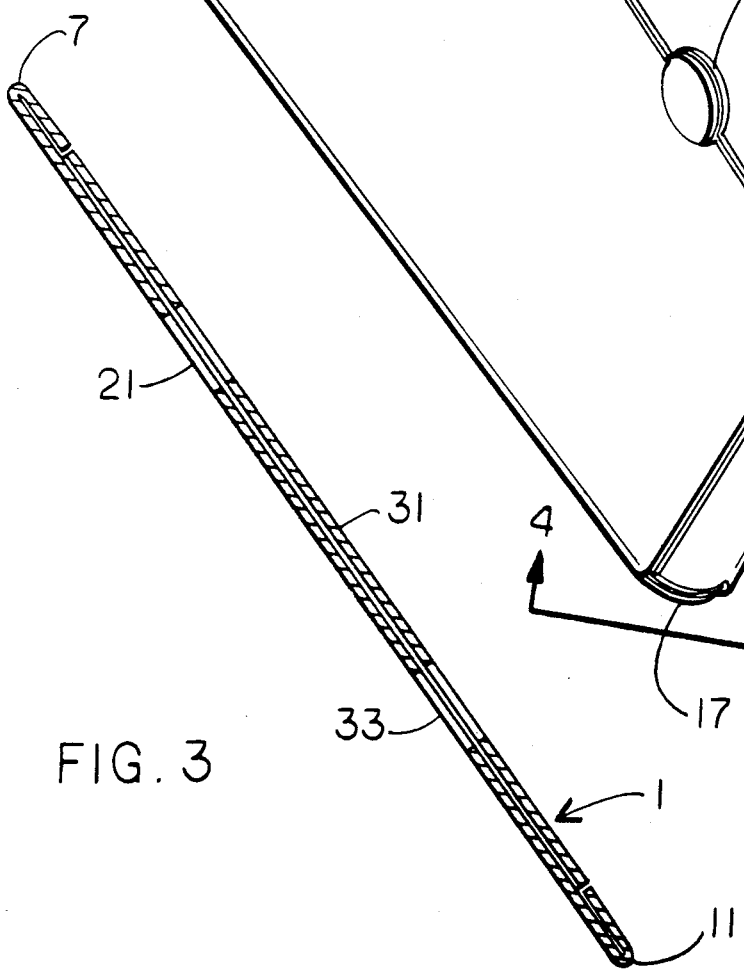
FIG. 3 of the drawings is a cross-sectional view along the line 3—3 of FIG. 2.

FIG. 3 of the drawings is a cross section across the line 3—3 of FIG. 2 showing the abutment of opposite faces 31 and 33 of the single unitary sheet of corrugated cardboard material. In the central area as the opposing faces contact one another, adhesive is utilized to rigidify the structure. The adhering of opposing faces takes place after article locating means have been placed through the various apertures 3. It is further seen that the configuration provides edges 7 and 11 which expose no severed corrugations and which comprises a majority of the perimeter of the shipping pallet.

The adhesive utilized to laminate opposing edges may be only conventional adhesive utilized with wood or corrugated cardboard. The adhesive lamination of opposing faces has been found to produce surprisingly enhanced durability and life. An unexpected advantage is the tendency for personnel at the point of use to continue to reuse the adhesively laminated pallet, whereas such personnel have heretofore quickly scrapped nonadhesively laminated pallets.

Figure 4:
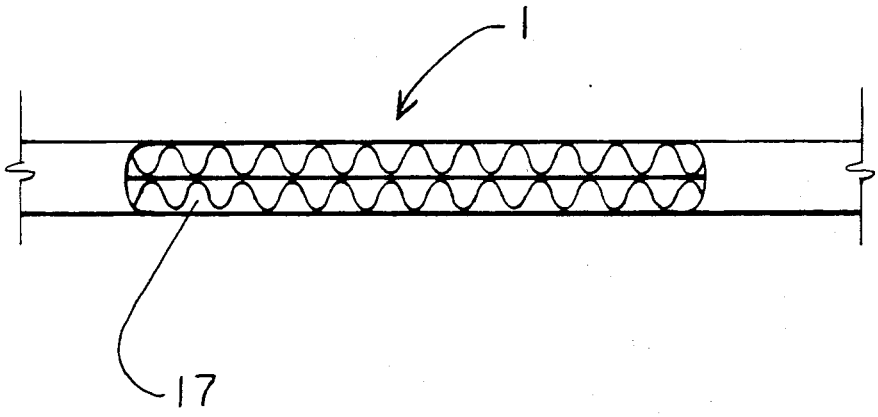
FIG. 4 of the drawings is an enlarged view along the line 4—4 of FIG. 2.

FIG. 4 of the drawings is a view along the line 4—4 of FIG. 2 and illustrates exposed corrugations at corner 17. Such exposure is at a minimum in accordance with the structure of this invention.

It is thus seen that the shipping pallet in accordance with this invention provides a novel shipping pallet with means for end-of-use handling not heretofore available on shipping pallets. It is further seen that the shipping pallet in accordance with this invention provides for production thereof from a unitary sheet of corrugated cardboard into a configuration with the substantial majority of the perimeter thereof having unsevered corrugations. As many variations will be apparent to those with skill in the art from a reading of the above description, such variations are within the spirit and scope of this invention as measured by the following appended claims.

What is claimed is:

1. A shipping pallet for use during shipping a plurality of the similarly shaped articles, comprising:

a generally rectangular backing member having arcuate corners formed of a single sheet of corrugated material, folded double along each edge of said single sheet toward the center of said single sheet whereby there are four folds merging to form an "I" shaped juncture of edges of said single sheet all within the perimeter of said backing member whereby said backing member comprises two thicknesses of corrugated material, with a majority of edges of said backing member being of folded corrugated material, with only said arcuate corners comprising severed corrugated material;

wherein the radius of the arc of said each arcuate corner being small in relation to the length of any edge of said backing member and wherein the folds of two opposing sides of said single sheet are of a length of substantially equal to said radius;

said backing member defining at least two passagways therethrough for mechanized handling of thereof, and said backing member defining openings for receipt of and containment of article support members.

2. The shipping pallet according to claim 1 further comprising an adhesive between said two thicknesses for laminating said two thicknesses.

3. The shipping pallet according to claim 1 wherein said each corner is formed from a 90° arc.

* * * * *